United States Patent [19]

Jones et al.

[11] 4,114,229

[45] Sep. 19, 1978

[54] SURFACE CLEANING APPARATUS

[75] Inventors: Terry H. Jones, Norman, Okla.; John J. Oakes, Garland, Tex.

[73] Assignee: Clarke-Gravely Corporation, Muskegon, Mich.

[21] Appl. No.: 352,623

[22] Filed: Apr. 19, 1973

Related U.S. Application Data

[63] Continuation of Ser. No. 158,357, Jun. 30, 1971, abandoned.

[51] Int. Cl.[2] ..... A47L 5/34

[52] U.S. Cl. ..... 15/320; 15/353

[58] Field of Search ..... 15/320, 321, 322, 353

[56] References Cited

U.S. PATENT DOCUMENTS

| | | | |
|---|---|---|---|
| 1,506,016 | 8/1924 | Lundgren | 15/320 X |
| 1,736,446 | 11/1929 | Keefer | 15/320 X |
| 1,801,135 | 4/1931 | Blogg | 15/320 |
| 3,262,146 | 7/1966 | Hays | 15/321 |
| 3,439,374 | 4/1969 | Wisdom | 15/320 X |
| 3,619,849 | 11/1971 | Jones | 15/321 |

*Primary Examiner*—Christopher K. Moore

*Attorney, Agent, or Firm*—Price, Heneveld, Huizenga & Cooper

[57] ABSTRACT

A downwardly open roller supported housing is provided, on its upper surface, with a handle equipped rearwardly and upwardly inclined casing. Transverse partitions, within the housing, form an air flow passageway open to the bottom of the housing and a liquid receiving chamber for used cleaning fluid. A nozzle, mounted in the housing, is connected by tubing with a source of cleaning fluid supply through a heater and detergent applicator for spraying the surface to be cleaned. A pump, supported by a housing partition, drains the used cleaning fluid chamber to a point of discharge by tubing extending through the casing. A blower, supported by a housing partition, induces air flow through the passageway for removing used cleaning fluid from the surface being cleaned.

12 Claims, 5 Drawing Figures

FIG. 1
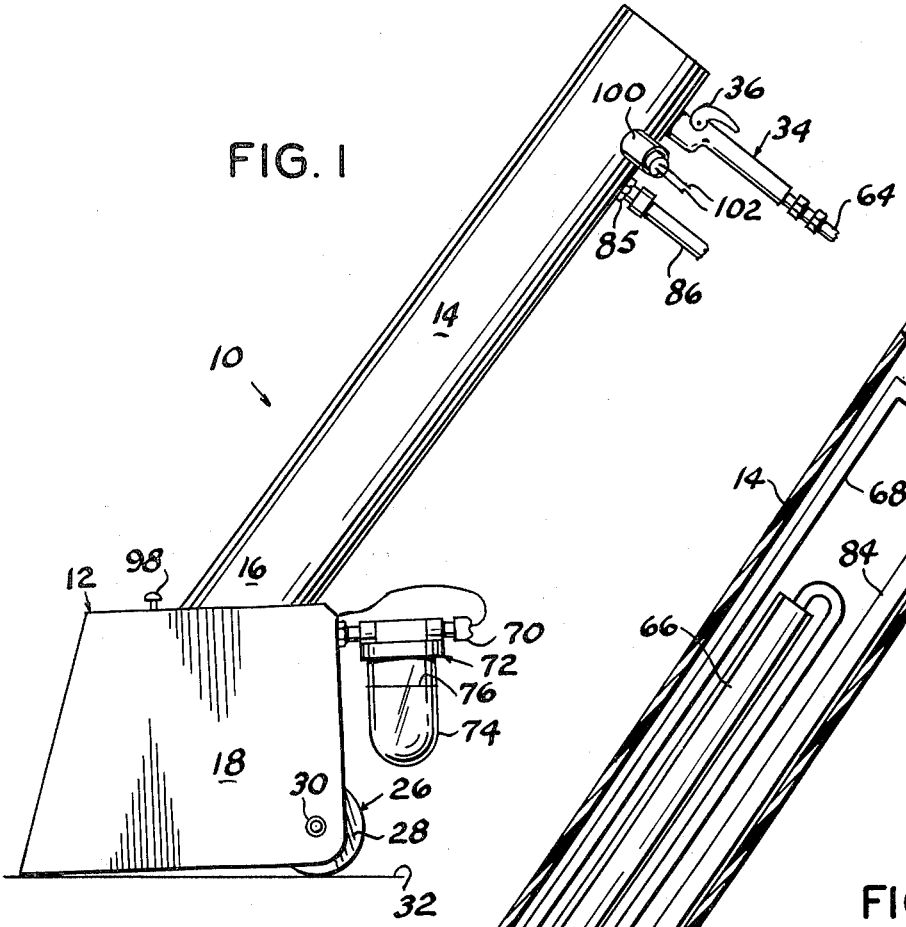
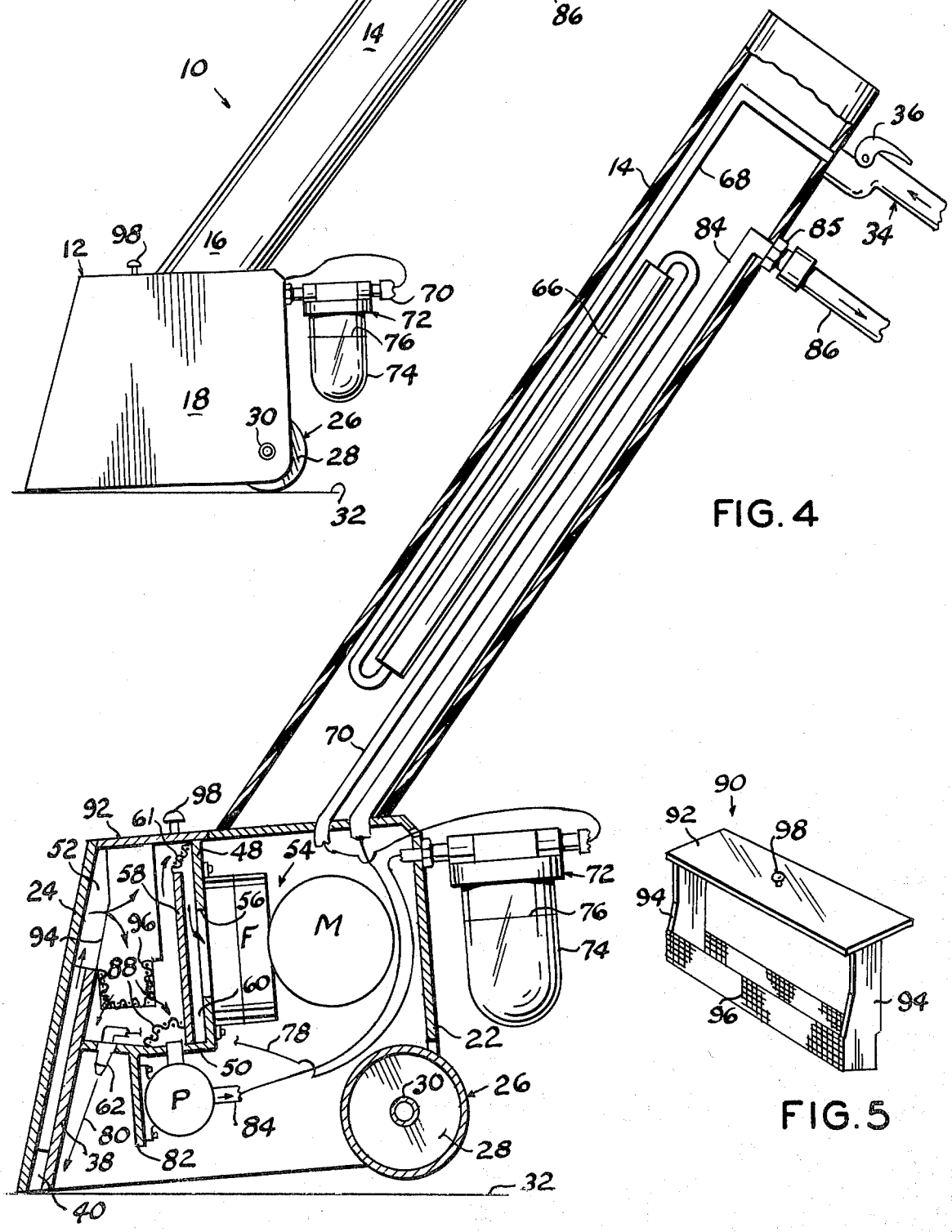
FIG. 4
FIG. 5

SURFACE CLEANING APPARATUS

CROSS REFERENCE TO RELATED APPLICATION

This is a continuation application of parent application Ser. No. 158,357, filed June 30, 1971, now abandoned, and entitled SURFACE CLEANING APPARATUS.

BACKGROUND OF THE INVENTION

1. Field of the Invention

This invention relates to a floor cleaning apparatus and more particularly to a floor and carpet cleaning mechanism wherein a cleaning fluid is applied to the floor or carpet and removed therefrom in the path of movement of the mechanism.

In order to prolong the life of floor coverings it is essential that they be periodically cleaned of dirt, sand, or the like. Such cleaning is relatively easily accomplished where the floor surface is defined by material having a smooth upper surface, such as linoleum or hardwood, however, when the floor is covered by a rug or carpet, areas of heavy traffic tend to have dirt ground into the piles of the rug which cling to the fibers thereof and are not easily removed by ordinary dry vacuum cleaning action. One method of carpet cleaning, commonly called "dry shampooing" takes the form of relatively dry soap suds or chemically treated granulated material which is applied to the rug piles and brushed in and, after a selected period of time, is dry vacuumed off the rug. Repeated shampooing in this manner results in a build-up of shampoo residue and foreign matter, such that shampooing is no longer effective. Furthermore, in some types of carpet material the mechanical scrubber tends to generate static electricity in the carpet piles which attract opposite polarity of foreign matter particles thus rendering the foreign matter more difficult to remove from the piles of the carpet.

Another method comprises the application of a liquid, usually water mixed with soap or a detergent, which is usually applied to the rug piles by a rotating scrub brush and thereafter removing as much of the soap and water as is possible by vacuuming. This latter process results in substantially completely wetting the rug, requiring an extended period of drying time during which it is preferred that traffic be kept off the rug.

2. Description of the Prior Art

The prior art patents generally disclose two types of surface cleaning devices. One type being self-contained units, such as U.S. Pat. Nos. 3,040,362; 3,060,484; 3,332,101 and Re. 25,939, wherein a generally upright housing, equipped with brush-like scrubbing means at its depending end, is provided with a tank containing a cleaning fluid to be applied to the surface being cleaned which is removed after use by suction generating means contained by the housing and deposited in a container within the housing. The other type surface cleaning apparatus, such as is disclosed by U.S. Pat. Nos. 3,079,285; 3,262,146 and 3,496,592, generally comprise a floor engaging cleaning head portion through which a cleaning agent is applied to the surface to be cleaned with the head connected by flexible tubing to a wheel supported vacuum generating structure containing a quantity of the cleaning fluid and a used fluid receiving tank.

The self-contained units have the disadvantage of containing a limited quantity of cleaning agent which must be frequently replaced and the used fluid container emptied.

The principal disadvantage of the other cleaning devices, featuring the wheel supported structure having a tank of the cleaning agent and used fluid receiving reservoir, is the necessity of moving this equippment with the operator from room to room as well as the additional expense involved in initial and maintenance cost.

The principal distinction between this invention and the above numbered patents resides in forming a cleaning device having some of the desirable features of the above two types of cleaning devices. This has resulted in a relatively lightweight unit which may be controlled by one operator wherein a source of water is connected by elongated tubing to the device from a conventional water supply line, such as a sink faucet, wherein the water is mixed with a detergent before being applied to the surface to be cleaned in a spraying action. Further, the used cleaning fluid is picked up from the surface of the rug immediately following its application thereto by a vacuum generating motor contained by the device thus minimizing the wetting action of a rug, or the like. A pump within the device also operates simultaneously with the vacuum generating motor to discharge the used cleaning fluid through an elongated flexible tube to a point of discharge, such as the drain of the sink supplying the water. Further, the mass of the device, which may be easily controlled by the operator, is utilized to firmly contact the suction nozzle intake of the device with the floor surface being cleaned in a manner similar to a squeegee cleaning action.

SUMMARY OF THE INVENTION

A generally rectangular downwardly open housing is provided with transverse partitions forming a downwardly open suction nozzle portion at the forward end of the housing which communicates with a used cleaning fluid receiving chamber. A blower, connected with one of the partitions, generates a suction action through the nozzle and used cleaning fluid chamber. An angularly upwardly and rearwardly directed casing, connected at its depending end with the top of the housing, forms a handle and control means for moving the device which is normally supported and balanced by the operator on a roller transversely journalled by the rearward end portion of the housing. An elongated flexible water supply tube is connected at its remote end to a source of supply, such as a sink faucet, and is connected at its other end to a nozzle supported by a housing partition with a heater interposed in the tubing extending through the casing for heating the water. A detergent dispenser is interposed within the water line between the heater and nozzle for mixing detergent with the water. A pump supported by a housing partition has its intake screen covered to filter lint, or the like, from the used cleaning fluid entering the used fluid receiving chamber with the discharge port of the pump connected with an elongated length of preferably transparent tubing extending through the casing and connected at its remote end to the drain of the sink adjacent the water supply.

The principal object of this invention is to provide a floor and rug cleaning apparatus for applying a constant spray of heated cleaning fluid to the surface to be cleaned adjacent and in the path of movement of a cleaning head and continuously removing the used cleaning fluid and lossensed dirt, or the like, from the surface being cleaned in a vacuuming action leaving the cleaned surface in substantially a dry state.

BRIEF DESCRIPTION OF THE DRAWINGS

FIG. 1 is a side elevational view of the device;

FIG. 4 is a vertical cross-sectional view taken substantially along the line 4—4 of FIG. 3; and, FIG. 5 is a perspective view, to a reduced scale, of a fluid and lint screening unit.

DESCRIPTION OF THE PREFERRED EMBODIMENTS

Figure 2:
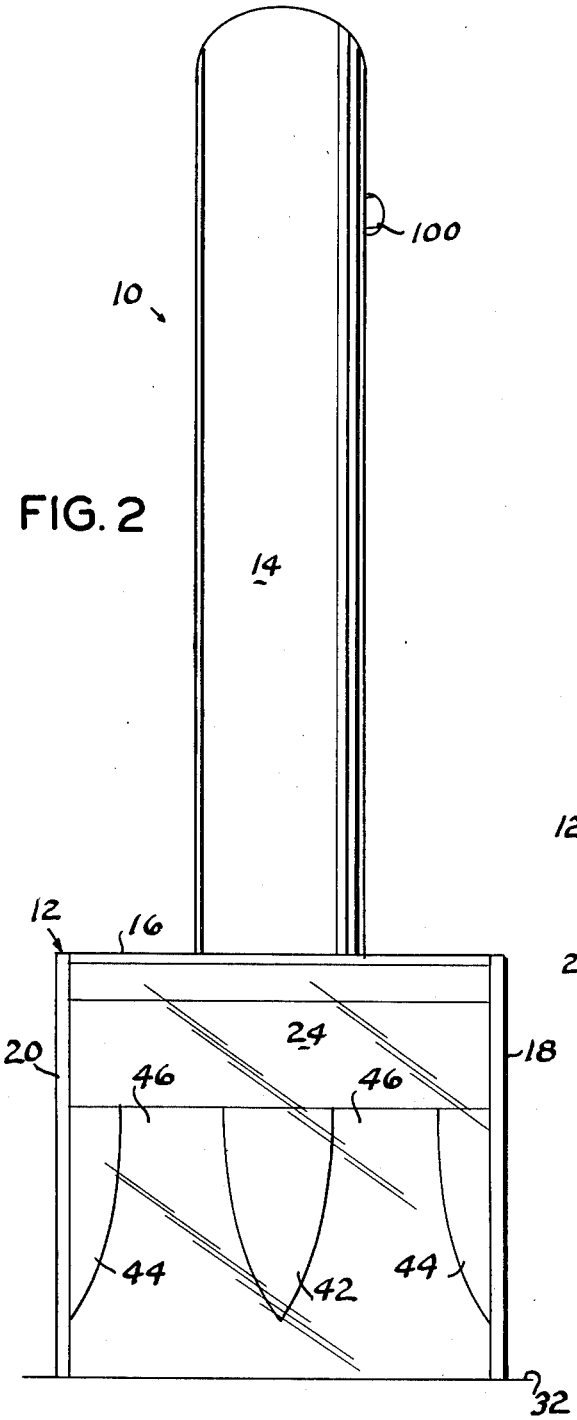
FIG. 2 is a front elevational view, to a larger scale.
Figure 3:
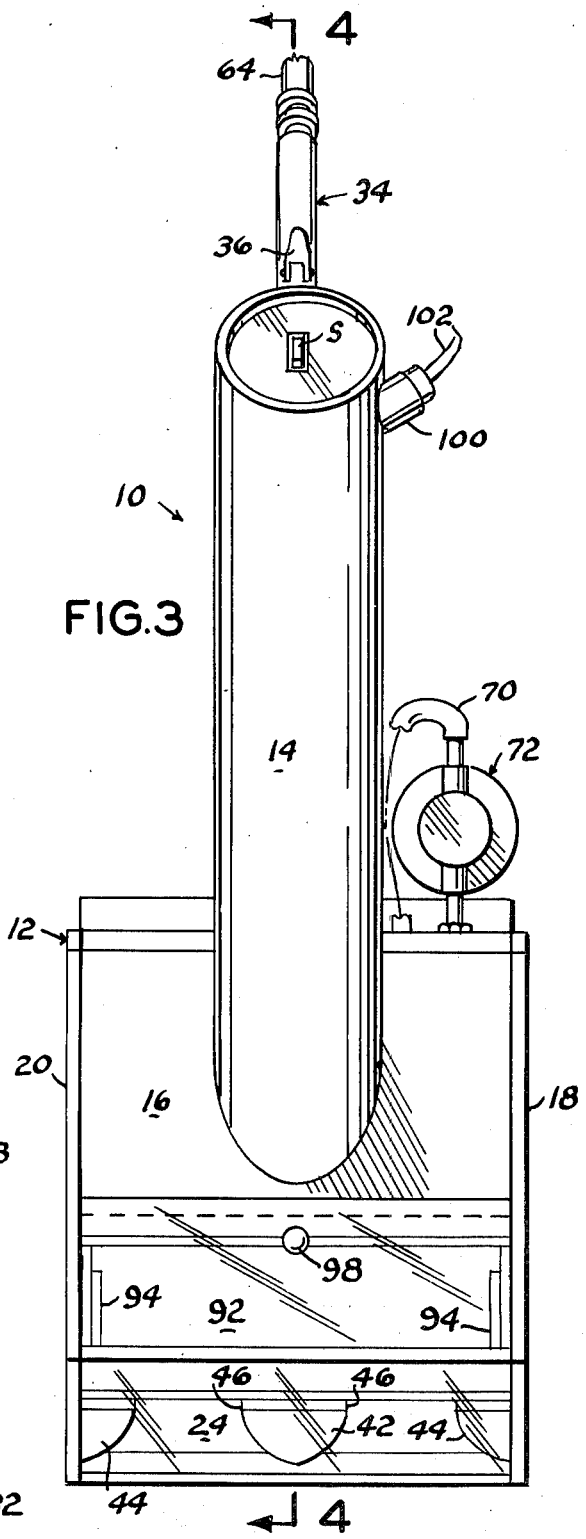
FIG. 3 is a top view.

Like characters of reference designate like parts in those figures of the drawings in which they occur.

In the drawings:

The reference numeral 10 indicates the cleaning device, as a whole, comprising a housing 12 and a control casing 14. The housing 12 is substantially rectangular having an open bottom, a horizontal top wall 16 joined to vertical side walls 18 and 20, a vertical back wall 22 and a forwardly and downwardly inclined, preferably transparent, front wall 24. A cylindrical tube-like roller 26, having closed ends 28, is journalled by a tubular axle 30 extending transversely through the side walls 18 and 20 adjacent the rear wall 22 so that a peripheral portion of the roller 26 projects downwardly beyond the horizontal lower limit of the housing side walls for supporting the rearward portion of the housing in spaced relation above the surface of the floor, or the like, indicated by the line 32. The position of the tubular axle 30 also positions a peripheral portion of the roller 26 rearwardly of the plane of the rear wall 22. The advantage of using a cylindrical roller 26 is that it distributes the mass of the device 10 over a larger area than caster wheels, or the like, when being moved across a carpeted area and further, the device may be moved up or down stairs wherein the exposed peripheral portion of the roller 26 permits the roller to contact and follow the surface of the riser and upper surface of stairtreads as it is moved up or down stairwells. When in an at rest position, the device is supported by the roller 26 with the depending edge of the front wall 24 resting on the supporting surface 32.

Referring more particularly to FIG. 4, the casing 14 is connected, at its depending end, to the upper surface of the rearward portion of the housing top wall 16 and projects angularly rearward and upward therefrom a selected distance. A tubular member is connected, at one end, to a peripheral portion of the casing 14 adjacent its upper limit and projects laterally downwardly in a rearward direction from the casing to form a handle 34. The handle 34 is provided with a "quick opening" control valve 36 for the purposes readily apparent.

The housing 12 is provided with a transverse first partition 38 positioned in selected spaced relation parallel with and rearwardly of the front wall 24. The depending edge of the first partition lies in the plane defined by the depending edges of the side walls and front wall while its upper limit terminates in a horizontal plane, intermediate the height of the front wall 24, thus forming a suction nozzle or opening 40 extending between the side walls 18 and 20 for the purposes readily apparent.

The first partition 38 is maintained and supported in spaced relation with respect to the inner surface of the front wall 24 by a plurality of spacers or guides 42 and 44 planar in general configuration and characterized by arcuate marginal edges which are interposed between the front wall 24 and front partition 38 and define a pair of passageways or channels 46 at the upper limit of the nozzle opening 40 reducing the cross sectional area of the flow path of the suction nozzle and increase the velocity of used cleaning fluid and air drawn therethrough as hereinafter explained.

A second transverse partition, comprising a vertical panel portion 48 joined to a substantially horizontal panel portion 50 in substantially right angular relation, divides the forward upper portion of the housing interior to form an air passageway and used cleaning fluid receiving compartment or chamber 52.

Blower means 54, comprising a motor M drivably connected with a fan F, is positioned within the housing with the fan F supported by the vertical partition panel 48 around an intake opening 56 therein. An upstanding partition-like shield or wall 58 extends transversely through the rearward portion of the chamber 52 with the depending edge of the wall 58 secured to the horizontal partition panel 50 with the its lateral end edges secured to the inner surface of the respective housing side walls 18 and 20 and terminates, at its upper horizontal limit, in downwardly spaced relation with respect to the plane of the housing top wall 16. The wall 58 is positioned in parallel spaced relation forwardly of the vertical partition panel 48 to form an air compartment 60 communicating with the fan intake opening 56. A screen 61 extends between the upper limits of the wall 58 and panel 48 defining the opening of the air compartment 60 to exclude lint, or the like. The fan F exhausts air downwardly through the open bottom of the housing.

A spray head 62 extends downwardly through and is supported by the partition panel 50 with its outlet end directed toward the depending horizontal limit of the suction nozzle 40 rearwardly of the first partition 38 to apply a spray of cleaning fluid, coextensive with the transverse distance between the side walls 18 and 20, on the surfce 32 as hereinafter explained.

An elongated length of flexible tubing 64 is connected, at one end, with the handle 34 and connected at its other end with a water supply, preferably hot water, such as a sink faucet, or the like. An electrical resistance heater 66 is mounted within the casing 14 and has one of its ends connected to the casing connected end of the handle 34 by tubing 68. Other tubing 70 connects the other end of the heater 66 to the intake port of a conventional full flow mixing unit 72 mounted on the housing rear wall 22. The mixing unit 72 is preferably provided with a transparent reservoir 74 containing a quantity of cleaning agent or detergent, indicated by the line 76, which mixes with the water flowing through the unit 72. The discharge port of the unit 72 is connected by tubing 78 to the spray nozzle 62, thus, when the handle valve 34 is manually opened water flows into and is further heated, to a selected temperature, by the heater 66, through the unit 72 where it is mixed with a selected quantity of detergent 76 and is deposited by the sprayer 62 on the surface 32, as indicated by the arrow 80. A fluid pump P is mounted on a bracket 82 depending from the partition panel 50 with the intake port of the pump extending through the panel 50 and communicating with the chamber 52. The output port of the pump P is connected to tubing 84 which extends through the housing and casing 14 and is connected with a fitting 85 at the upper end portion of the casing wall. An elongated discharge tube 86, preferably transparent tubing, is connected with the casing connected fitting 85 and is connected at its other end or opens into a drain, such as the drain of the sink, adjacent the water supply. The purpose of the clear tubing is to determine whether or not the device is discharging dirty used cleaning fluid. The intake port of the pump is preferably covered by a screen 88 to separate lint or other debris from the water entering the pump P.

Referring also to FIG. 5, the numeral 90 indicates a screen equipped receptacle or screener which is preferably supported by the housing within the chamber 52 for primary filteration or screening of the used cleaning fluid. The screener 90 comprises preferably a transparent panel 92 forming a portion of the upper wall area of the housing and is disposed in the plane thereof adjacent the upper limit of the forward wall 24, between the side walls 18 and 20 and forwardly of the position of the casing 14. The screener includes a pair of side panels 94 depending from the respective end portions of the top panel 92 adjacent the inner limit of the respective housing side walls 18 and 20. The side panels 94 terminate downwardly in spaced relation with respect to the partition panel 50. The depending end portions of these side panels 94 are interconnected by a screen 96 substantially defining a channel or U-shape in cross-section so that used cleaning fluid containing lint, or the like, falls by gravity through the screen 96 to filter out lint. The screener 90 is easily removed for cleaning by lifting it out of the chamber 52 by a knob-like handle 98. In the event the screener 90 is not used its panel portion 92 forms a part of the housing top 16 as an inspection and access plate.

An electrical supply receptacle 100 is connected with the casing 14 near the handle 34 for receiving a conventional plug and wiring 102 and supplying electrical energy, from a current source, not shown, to the motor M, pump P and water heater 66 which are interconnected by wiring, not shown, wth suitable controls including an "off-on" switch S positioned within the upper end portion of the casing 14.

Operation

In operation the supply tube 64 and discharge tube 86, connected respectively with the handle 34 and discharge fitting 85, are respectively connected at their other ends to a source of water and a drain, neither of which are shown. The wiring 102 is connected with a source of electrical energy. The tubing 64, 86 and the wiring 102 are preferably secured in side-by-side relation for ease of control when operating the device 10. The switch S is moved to its "on" position and water heated by the heater 66 is applied to the surface 32 to be cleaned by manual control of the handle valve 36. The operator manually lifts the rearward portion of the device off the surface 32, so that the depending edge of the front wall 24 remains in contact with the surface 32 wherein a major portion of the mass of the device is substantially supported by the depending edge surface of the front wall 24. This positions the depending edge surface of the first partition 38 in close spaced relation to the surface 32 to enhance air flow through the nozzle opening 40. While continuing the cleaning agent spray on the surface 32, the device is manually pulled in a rearward direction so that the depending edge surface of the forward wall 24 performs a squeegee or wiping action across the surface 32 thus removing the cleaning fluid, dirt and grime contained thereby. The used cleaning fluid is drawn upwardly in the direction of the arrow through the suction nozzle 40 and into the chamber 52 where the air and water separates with the air entering the compartment 60 being discharged downwardly through the housing by the fan F while the water is removed by the pump P to the point of discharge.

Obviously the invention is susceptible to changes or alterations without defeating its practicability, therefore, I do not wish to be confined to the preferred embodiment shown in the drawings and described herein.

I claim:

1. A portable apparatus for cleaning a floor surface, comprising: a downwardly open rectangular housing having a forward wall and a rearward wall; upwardly and rearwardly directed handle means connected with said housing; a first partition transversely dividing said housing and forming a suction nozzle in cooperation with said forward wall; a second partition transversely dividing said housing and forming a used cleaning fluid receiving chamber communicating with said suction nozzle; said second partition including an aperture therethrough; blower means mounted within said housing generally behind said second partition and generally adjacent said aperture and communicating with said aperture for rapid air evacuation of said chamber and causing a large volume of air and used cleaing fluid to be drawn through said suction nozzle; a shield disposed generally in front of said aperture within said chamber, said shield being spaced from said second partition and generally covering said aperture; said shield including an opening at the top of said shield whereby air is drawn from said chamber by said blower through the opening at the top of said shield and then through said aperture; a liquid pump within said housing and having an intake port communicating with said chamber for evacuating used cleaning fluid, said liquid pump having an outlet port; elongated discharge tubing connected, at one end, with said outlet port and communicating, at its other end, with a remote source of disposal; sprayer means supported within said housing for spraying a cleaning fluid on a portion of a floor surface to be cleaned adjacent and ahead of said suction nozzle as the suction nozzle is moved across a floor; elongated supply tubing connected, at one end, with said spraying means and connected, at its other end, with a remote constant source of fluid.

2. A portable apparatus for cleaning a floor surface, comprising: a downwardly open rectangular housing having a forward wall and a rearward wall; upwardly and rearwardly directed handle means connected with said housing; a first partition transversely dividing said housing and forming a suction nozzle in cooperation with said forward wall; a second partition transversely dividing said housing and forming a used cleaning fluid receiving chamber communicating with said suction nozzle; blower means within said housing and communicating with said chamber for rapid air evacuation of said chamber and causing a large volume of air and used cleaning fluid to be drawn through said suction nozzle; a liquid pump within said housing and having an intake port communicating with said chamber for evacuating used cleaning fluid, said liquid pump having an outlet port; elongated discharge tubing connected, at one end, with said outlet port and communicating, at its other end, with a remote source of disposal; sprayer means supported within said housing for spraying a cleaning fluid on a portion of a floor surface to be cleaned adjacent and ahead of said suction nozzle as the suction nozzle is moved across a floor; elongated supply tubing connected, at one end, with said spraying means and connected, at its other end, with a remote constant source of fluid; an electrical resistance heater connected with a source of electrical energy and interposed in said supply tubing; wiring connecting a source of electrical energy with said blower means and said pump; and, a detergent containing unit interposed in said supply tubing between said heater and said sprayer means.

3. The apparatus according to claim 2 and further including: screen means within the used fluid chamber for filtering fluid entering said pump.

4. The apparatus according to claim 3 and furtheer including: an axle extending transversely through said housing adjacent the lower limit of said rearward wall; and, roller means substantially coextensive with a transverse dimension of said housing and journalled by said axle for normally supporting a major portion of the mass of said apparatus.

5. The apparatus according to claim 3 including an opening into said chamber generally above said screen means; a transparent access cover means over said opening allowing inspection therethrough.

6. The apparatus according to claim 1 comprising a screen across said opening at the top of said shield.

7. The apparatus according to claim 1 and further including: screen means within said used fluid chamber for filtering fluid entering said pump.

8. The apparatus according to claim 7 including an opening into said chamber generally above said screen means; a transparent access cover means over said opening allowing inspection therethrough.

9. The apparatus of claim 1 in which said opening at the top of said shield extends from said second partition to the top of said shield whereby air flows generally over the top of said shield and downwardly through said opening.

10. The apparatus according to claim 9 comprising a screen across said opening at the top of said shield.

11. A small, compact carpet cleaner, comprising: an elongated hollow, generally rectangular housing; a roller secured to said housing and supporting said housing; means for pulling said housing comprising a handle; downwardly facing juxtaposed, transversely arranged discharge and intake passages formed in said housing at the opposite end thereof from said handle and having widths substantially coinciding with the width of said housing, the discharge passage being positioned toward said handle from the intake passage; means for providing water from a source of water; means comprising a connection between said water providing means and downwardly facing nozzle means for discharging water in admixture with measured amounts of liquid soap or detergent through said discharge passage onto the surface of a carpet being cleaned; means carried in said housing, comprising a suction fan and a motor for driving said fan, for picking up used water from the surface of the carpet being cleaned and drawing it in admixture with atmospheric air through said intake passage into said housing; a used water collecting tank in said housing into which the used water flows; and means comprising a pump in said housing for discharging used water from said tank outward from said housing.

12. A portable apparatus for cleaning a floor surface comprising: a downwardly open rectangular housing having a forward wall and a rearward wall; upwardly and rearwardly directed handle means connected with said housing; a first partition transversely dividing said housing and forming a suction nozzle in cooperation with said forward wall; a second partition transversely dividing said housing and forming a used cleaning fluid receiving chamber communicating with said suction nozzle; said second partition including an aperature therethrough; blower means mounted within said housing generally behind said second partition and generally adjacent said apperture and commuicating with said aperture for rapid air evacuation of said chamber and causing a large volume of air and used cleaning fluid to be drawn through said suction nozzle; a shield disposed generally in front of said aperture within said chamber, said shield being spaced from said second partition and generally covering said aperture; a liquid pump within said housing and having an intake port communicating with said chamber for evacuating used cleaning fluid, said liquid pump having an outlet port; elongated discharge tubing connected, at one end, with said outlet port and communicating, at its other end with a remote source of disposal; sprayer means supported within said housing for spraying a cleaning fluid on a portion of a floor surface to be cleaned adjacent and ahead of said suction nozzle as the suction nozzle is moved across a floor; and elongated supply tubing connected, at one end, with a remote constant source of fluid.

* * * * *

UNITED STATES PATENT AND TRADEMARK OFFICE

CERTIFICATE OF CORRECTION

PATENT NO. : 4,114,229

DATED : September 19, 1978

INVENTOR(S) : Terry H. Jones et al

It is certified that error appears in the above-identified patent and that said Letters Patent are hereby corrected as shown below:

Column 2, line 68:

"lossensed" should be --loosened--

Column 4, line 22:

Delete "the"

Column 7, line 14, Claim 4:

"furtheer" should be --further--

Column 8, line 26, Claim 12:

"aperature" should be --aperture--

Column 8, line 29, Claim 12:

"apperture" should be -- aperture --.

UNITED STATES PATENT AND TRADEMARK OFFICE

CERTIFICATE OF CORRECTION

PATENT NO. : 4,114,229

DATED : September 19, 1978

INVENTOR(S) : Terry H. Jones et al

It is certified that error appears in the above-identified patent and that said Letters Patent are hereby corrected as shown below:

Column 8, line 29, Claim 12:

"commuicating" should be --communicating--

Signed and Sealed this

*Tenth* Day of *July 1979*

[SEAL]

*Attest:*

*Attesting Officer*

LUTRELLE F. PARKER

*Acting Commissioner of Patents and Trademarks*